US007878833B2

(12) United States Patent
Chen et al.

(10) Patent No.: US 7,878,833 B2
(45) Date of Patent: Feb. 1, 2011

(54) ELECTRICAL CONNECTOR HAVING INSULATIVE HOUSING CONFIGURED WITH HERMAPHRODITIC HALVES

(75) Inventors: Yong-Jun Chen, ShenZhen (CN); Xian-Kui Shi, ShenZhen (CN); Chung-Yen Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/384,717

(22) Filed: Apr. 8, 2009

(65) Prior Publication Data

US 2009/0253304 A1 Oct. 8, 2009

(30) Foreign Application Priority Data

Apr. 8, 2008 (CN) ..... 2008 2 0035031 U

(51) Int. Cl.
*H01R 13/28* (2006.01)

(52) U.S. Cl. ..... 439/284; 439/638

(58) Field of Classification Search ..... 439/284, 439/638, 628, 687, 606, 736
See application file for complete search history.

(56) References Cited

U.S. PATENT DOCUMENTS

| | | | | |
|---|---|---|---|---|
| 4,108,527 | A * | 8/1978 | Douty et al. | 439/465 |
| 4,857,016 | A * | 8/1989 | Benscoter et al. | 439/638 |
| 6,305,986 | B1 * | 10/2001 | Hwang | 439/607.44 |
| 6,743,052 | B1 * | 6/2004 | Lin et al. | 439/638 |
| 7,081,003 | B1 * | 7/2006 | Gregori et al. | 439/352 |
| 2003/0045176 | A1 * | 3/2003 | Liu | 439/687 |
| 2004/0185719 | A1 * | 9/2004 | Wang | 439/638 |

* cited by examiner

*Primary Examiner*—Briggitte R Hammond
(74) *Attorney, Agent, or Firm*—Wei Te Chung; Andrew C. Cheng; Ming Chieh Chang

(57) ABSTRACT

An electrical connector (100) comprises a first connector (2), a second connector (3) electrically connecting with the first connector, an insulator (5) molded over the first connector and the second connector, and a housing member including a top housing (1) and a bottom housing (4) combined together to enclose the insulator (5) and at least one of the first and second connectors therein. The insulator (5) defines an expansion (51) thereon, said expansion of the insulator is located in a corresponding depression defined in an interior side of the top or bottom housing.

13 Claims, 4 Drawing Sheets

ELECTRICAL CONNECTOR HAVING INSULATIVE HOUSING CONFIGURED WITH HERMAPHRODITIC HALVES

BACKGROUND OF THE INVENTION

1. Field of the Invention

The present invention generally relates to an electrical connector, and more particularly to an electrical connector with an insulative housing configured by a pair of hermaphroditic halves.

2. Description of Related Art

The evolution of computer brings along a plurality of different standard of electrical connectors thereon. Nowadays, electrical connectors used for keyboard or mouse are mainly Universal Serial Bus (USB) or PS/2 (Mini Din) types. In order to meet the processing speed of the computer, most of the electrical connectors on keyboard or mouse are in accordance with USB standard, but previous computer may still adopt standard of PS/2, thus, an electrical adapter is required to signal transition. The electrical connector converts signal output of PS/2 connector into capable input of USB connector, and furthermore the electrical connector comprises a housing enclosing the PS/2 connector and the USB connector.

CN Patent No. 2569371Y issued to Li on Aug. 27, 2003 discloses an electrical connector with a housing which comprising a top housing and a bottom housing, the housing is configured with a square end and a round head. The electrical connector comprises a USB interface receptacle connector and a PS/2 interface connector, a protrusion is defined on front end of the USB receptacle connector and curved outwards, the USB receptacle connector is more likely to move in the space formed by the top housing and the bottom housing, so as to the electrical connection and signal transition are unstable.

Hence, it is desirable to have an improved structure to overcome the above-mentioned disadvantages of the prior art.

BRIEF SUMMARY OF THE INVENTION

Accordingly, the object of the present invention is to provide an electrical connector with a hermaphroditic housing reliably attached to a connector.

In order to achieve the above-mentioned object, an electrical connector in accordance with the present invention comprises a first connector, a second connector electrically connecting with the first connector, an insulator molded over the first connector and the second connector, and a housing member including a top housing and a bottom housing combined together to enclose the insulator and at least one of the first and second connectors therein. The insulator defines an expansion thereon, said expansion of the insulator is located in a corresponding depression defined in an interior side of the top or bottom housing.

Other objects, advantages and novel features of the invention will become more apparent from the following detailed description of the present embodiment when taken in conjunction with the accompanying drawings.

DETAILED DESCRIPTION OF THE INVENTION

Figure 1:
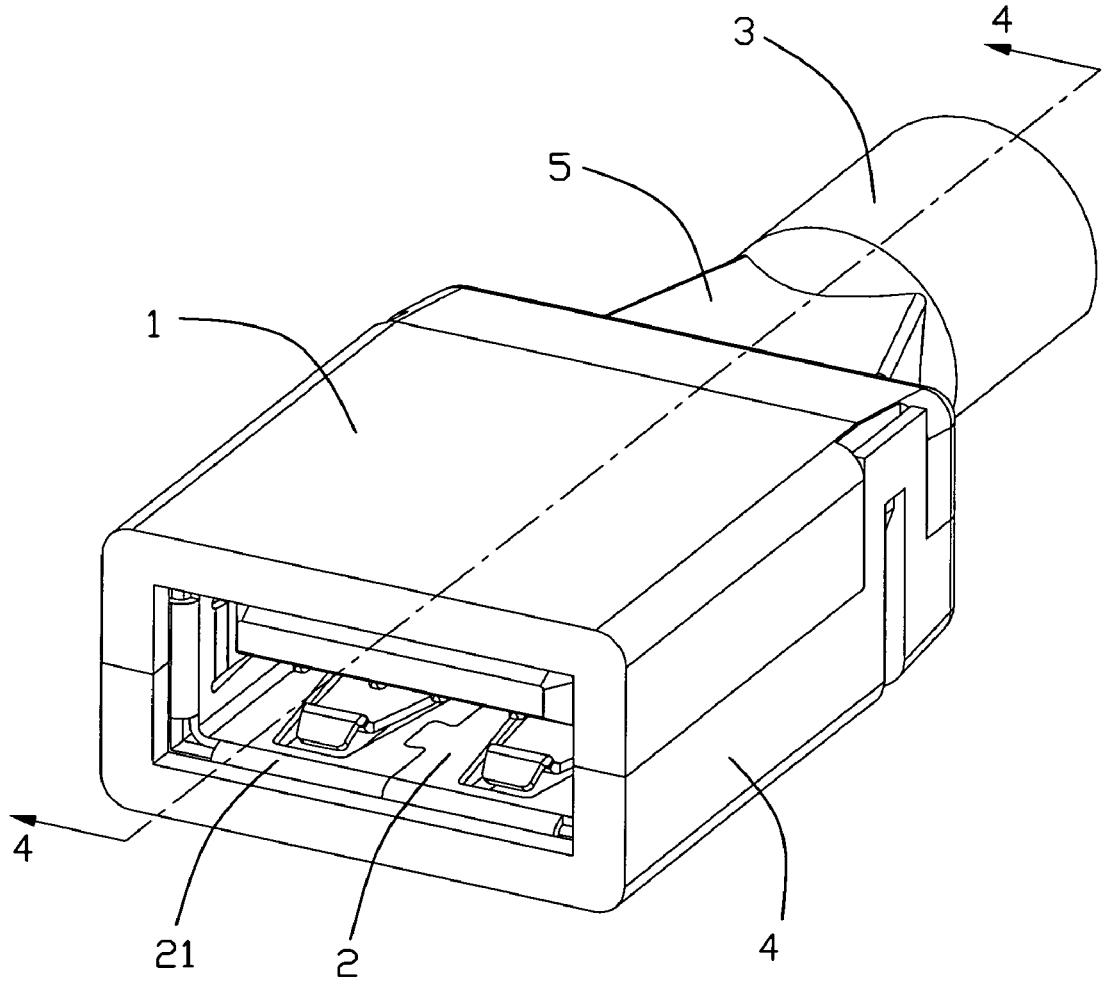
FIG. 1 is an assembled view of an electrical connector in accordance with the present invention.

Reference will now be made to the drawing figures to describe the present invention in detail.

Figure 2:
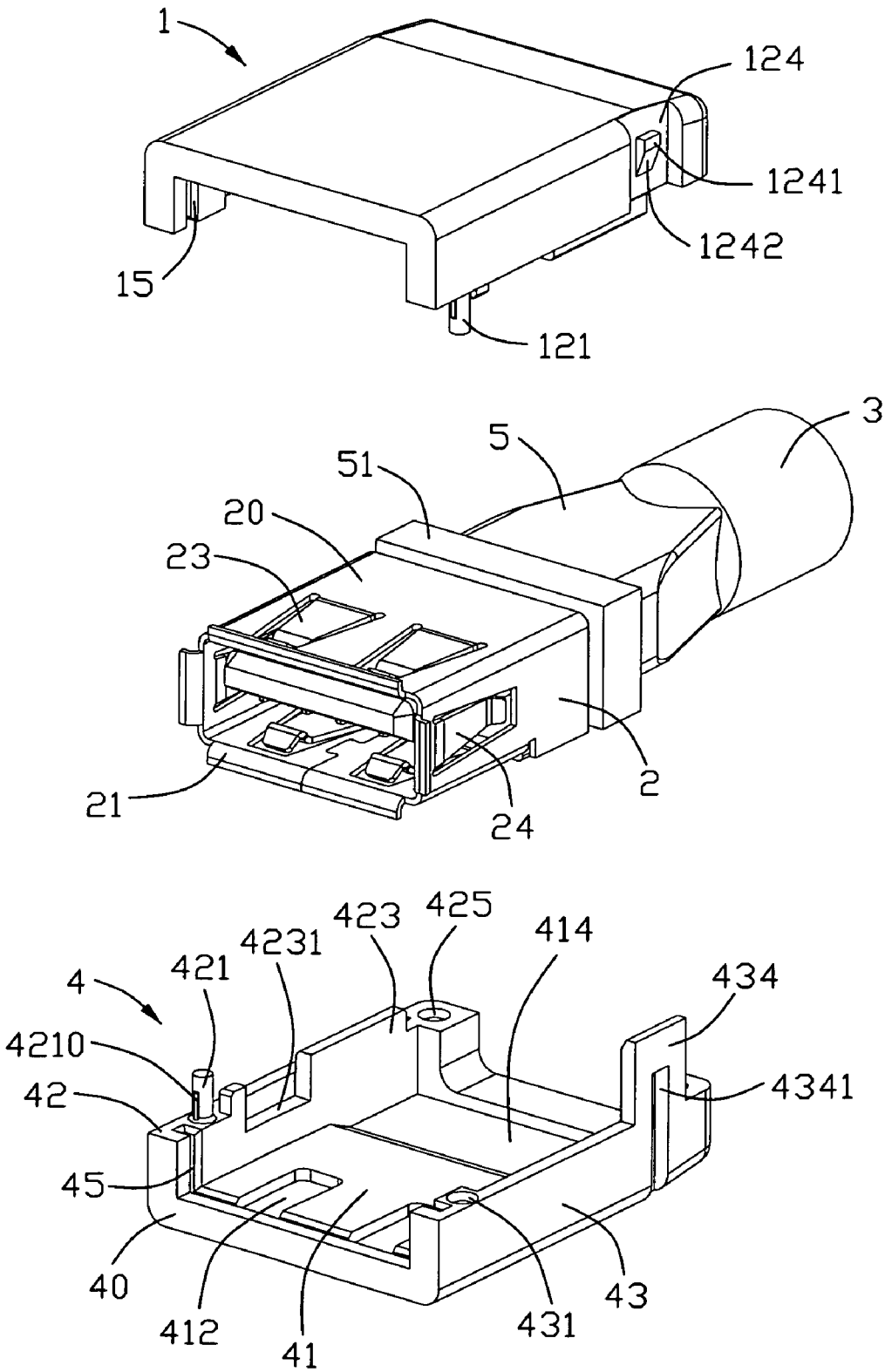
FIG. 2 is an exploded view of the electrical connector.

Referring to FIGS. 1-2, an electrical connector 100 in accordance with the present invention comprises a top housing 1, a first connector 2, a second connector 3 electrically connected with the USB receptacle connector 2, and a bottom housing 4 assembled to the top housing 1 to form a hermaphroditic housing member enclosing the first connector 2 therein. The first connector is a USB receptacle connector, and the second connector 3 is a PS/2 plug connector.

Referring to FIGS. 2, the USB receptacle connector 2 of the electrical connector 100 has a metallic shell 20 with a plurality of protrusions 21 curving outwards at front edge thereof, a pair of first elastic portion 23 are respectively defined on an upper surface and a lower surface of the metallic shell 20. Both sides of the metallic shell respectively define a second elastic portion 24. The PS/2 plug connector 3 is connected with the USB receptacle connector 2 via a plurality of wires 6 thereof electrically connected with contacts 26 of the USB receptacle connector 2. An insulator 5 is molded over a connecting area of the USB receptacle connector 2, the PS/2 plug connector 3 and the wires 6. The part of insulator 5 enclosing the USB receptacle connector 2 extends beyond the metallic shell 20 and forms an expansion 51.

Figure 3:
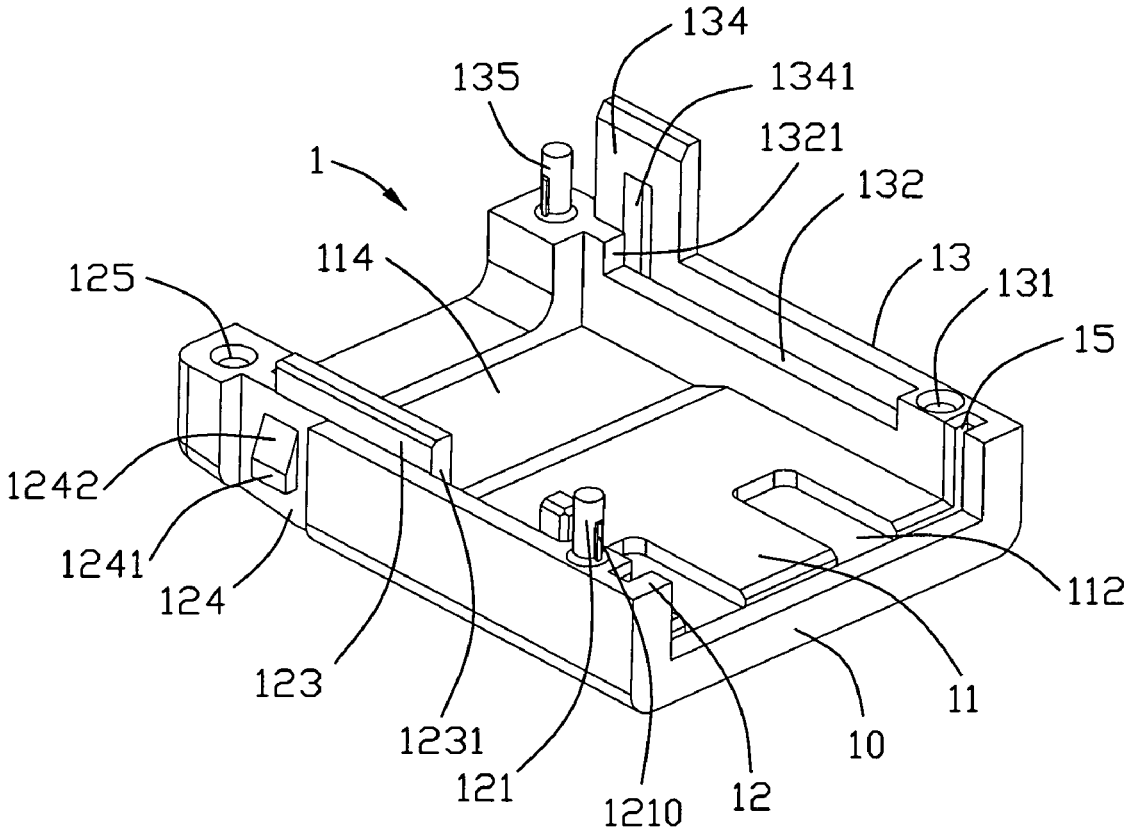
FIG. 3 is a perspective view of a top housing of the electrical connector shown in FIG. 2.
Figure 4:
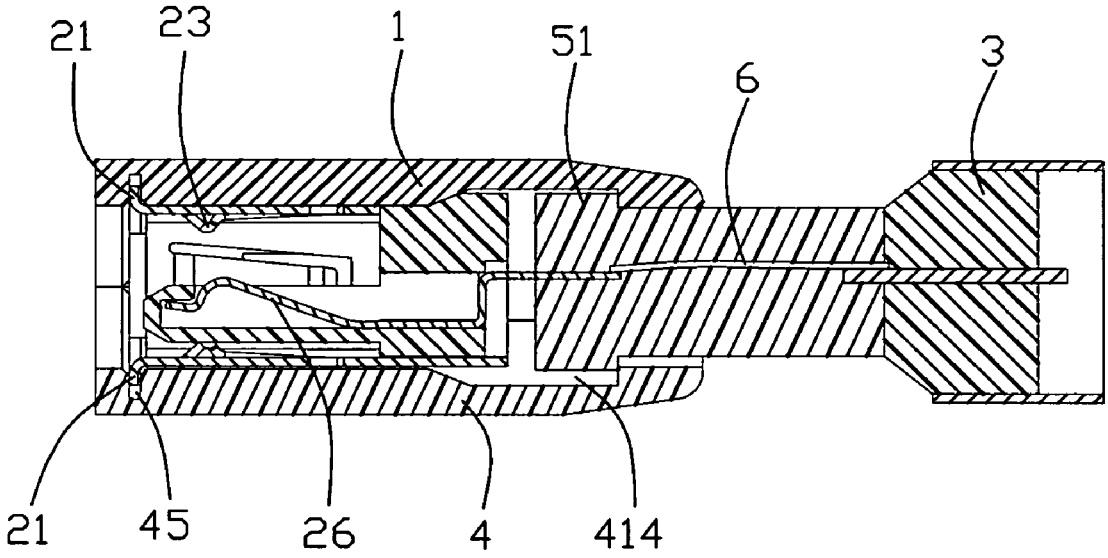
FIG. 4 is a cross-section view taken along line 4-4 of FIG. 1.

Referring to FIG. 3 and in conjunction with FIG. 2, the top housing 1 and the bottom housing 4 have the same shape and configuration as each other. The top housing 1 and the bottom housing 4 respectively comprise lower walls 11, 41, first lateral walls 12, 42, and second lateral walls 13, 43 opposite to the first lateral walls 12, 42. The first lateral walls 12, 42 define first posts 121, 421 in the front part and first openings 125, 425 in the rear part, ribs 1210, 4210 are formed on corresponding first posts 121, 421. Second openings 131, 431 are defined in corresponding second lateral walls 13, 43, the opening 131 is aligning with the first post 121 along a transverse direction and aligning with the first post 421 along up-to-down direction. A second post 135 is defined on the second lateral wall 13 and aligning with the first opening 125, another second post (not shown) is defined on the second lateral wall 43 and aligning with the first opening 425. A projection 123 extends downwardly along the first lateral wall 12, and a projection 423 extends upwardly along the first lateral wall 42. Depressions 1231, 4231 are respectively recessed from upper surfaces of the projections 123, 423. The first lateral wall 12 of the top housing 1 defines a receiving groove 124 on exterior surface, the receiving groove 124 is closer to the first opening 125 and has a block 1241 therein. The block 1241 has a slanted surface 1242 extending upwards slantways from a inner surface of the receiving groove 124. The second lateral wall 13 of the top housing 1 defines a longer cutout 132 along a front-to-back direction, a latch portion 134 is defined closer to the second post 135 and aligning with the receiving groove 124, the latch portion 134 extends beyond the second lateral wall 43. The latch portion 134 defines a latch hole 1341 penetrating through thereof. The bottom housing 4 has the same latch portion 434 and latch hole 4341, and also those same structures are omitted here.

The top housing 1 and bottom housing 4 respectively have slits 15, 45 adjacent to the first posts 121, 421, and the slits 15, 45 are located in front of corresponding posts 121, 421. The slits 15, 45 are of U-shape and spaced from front-end surfaces 10, 40 of the top housing 1 and the bottom housing 4 with a certain distance. The lower walls 11, 41 define a pair of recesses 112, 412 in front and depressions 114, 414 in the back respectively, the recesses 112, 412 are located adjacent to corresponding slits 15, 45, and the depressions 114, 414 are communicated with corresponding first lateral walls 12, 42 and second lateral walls 13, 43.

When assembly, the USB receptacle connector 2 is assembled into the bottom housing 4, the expansion 51 of the insulator 5 is put in the depression 414, part of the protrusion 21 is received in the slit 45, the first elastic portions 23 on the upper surface of the metal shell 2 align with corresponding recesses 412, the second elastic portion 24 on the right is aligned with the depression 4231 of the bottom housing 4 and the left one is aligned with the depression 1231 of the top housing 1. Then the top housing 1 is assembled to the bottom housing 4, the first post 121 of the top housing 1 is interferentially received in the first opening 431 of the bottom housing 4 via rib 1210 to enhance the combination therebetween. Simultaneity, the first post 421 of the bottom housing 4 is inserted into the first opening 131 of the top housing 1, the second post 135 of the top housing 1 is inserted into the second opening 425 of the bottom housing 4, with the second post of the bottom housing 4 inserted into the second opening 125 of the top housing. The first elastic portions 23 on the lower surface of the metal shell 2 align with corresponding recesses 112 of the top housing 1.

The protrusive portion 423 of the bottom housing 1 is received in the cutout 132 of the top housing 1, and abutting against an inner wall 1321. The latch portion 434 of the bottom housing 4 is sliderably received in the receiving groove 124 along the slanted surface 1242, the upper segment of the block 1241 is protruding outer than the slanted surface 1242 to lock with the latch portion 434. The upside of the protrusion 21 is located in the slit 15, and the slit 15 of the top housing 1 is cooperated with the slit 45 of the bottom 4 to position the USB receptacle connector 2 in the exterior housing.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

a USB connector defining a pair of first elastic portions at lateral side and a plurality of protrusions;

an insulator enclosing part of the USB connector and extending beyond the USB connector to form an expansion; and a pair of hermaphroditic top and bottom housings jointly enclosing the USB connector and interlocked to each other, the top housing defining a slit spaced from a front-end surface thereof with a certain distance, the protrusions located in the slit, both of the top housing and bottom housing comprising a lower wall, a first lateral wall and a second lateral wall respectively; wherein the lower wall defines a pair of recesses therein, the first lateral wall of the top housing extends downwardly to form a projection, the projection defines a depression recessed from upper surfaces thereof, the first elastic portions are aligning with corresponding depressions defined in a lateral side of the top or bottom housing, the second lateral wall defines a longer cutout, and the projection of the bottom housing is received in the cutout of the top housing, the bottom housing defines a latch portion, the top housing has a receiving groove with a block defined therein, the block has a slanted surface extending upwards and slantways from an inner surface of the receiving groove, and the latch portion of the bottom housing is received in the receiving groove of the top housing and locked with the block.

2. The electrical connector as claimed in claim 1, wherein the top housing comprises a first post and an first opening in the front thereof, a second opening and a second post in the back, wherein the first and second post have ribs.

3. The electrical connector as claimed in claim 1, wherein the USB connector comprises a pair of second elastic portions on upper surface and lower surface respectively, the second elastic portions align with corresponding recesses defined in a interior side of the top or bottom housing.

4. The electrical connector as claimed in claim 1, wherein the lower wall defines a depression communicated with the first lateral wall and second lateral wall, the expansion is located in the depression.

5. The electrical connector as claimed in claim 1, wherein the protrusions of said USB connector are defined on a metallic shell, and said slits are formed in inner faces of front portions of said top and bottom housings.

6. An electrical connector, comprising:

a first connector;

a second connector electrically connecting with the first connector;

an insulator integrally molded over the first connector and the second connector directly, the insulator defining an expansion thereon;

a housing member including a top housing and a bottom housing combined together to enclose the insulator and at least one of the first and second connectors therein, said expansion of the insulator located in a corresponding depression in an interior side of the top or bottom housing.

7. The electrical connector as claimed in claim 6, wherein the top housing and the bottom housing have the same configuration as each other, and can be interchanged.

8. The electrical connector as claimed in claim 6, wherein the first connector has a metallic shell and a plurality of contacts extending beyond the metallic shell, the insulator is attached to rear sections of the contacts.

9. The electrical connector as claimed in claim 8, wherein the metal shell has a plurality of protrusions formed at front edge thereof, the protrusions are received in corresponding slits defined in the top and bottom housings.

10. An adaptor comprising:

a USB connection unit equipped with an outer shell and defining a rectangular mating port with resilient USB contacts dispose therein;

a plug connection unit defining a circular mating port with the plug contacts disposed therein under condition that said USB connection unit and said plug connection unit are back to back arranged with each other;

a tail of the plug contact and tails of USB contacts being electrically connected to each other within an insulator;

a pair of housing units assembled to each other to sandwich not only the USB connection unit but also the insulator; wherein said housing units commonly enclose the whole USB connection unit and a part of the insulator.

11. The adaptor as claimed in claim 10, wherein an inner face of the housing units forms a recess to allow outward deflection of corresponding spring tangs formed on the outer shell when a complementary USB plug connector is mated into the rectangular mating port.

12. The adaptor as claimed in claim 10, wherein the housing units retains said insulator therein with an expansion of the insulator locked in depressions of the housing units.

13. The adaptor as claimed in claim 12, wherein said insulator is integrally molded over the USB connection unit and the plug connection unit.

* * * * *